US005733011A

United States Patent [19]

Young et al.

[11] Patent Number: 5,733,011

[45] Date of Patent: Mar. 31, 1998

[54] MULTIPLE POSITION TOOL CADDY SEAT

[75] Inventors: Richard A. Young, 321 S. Spring St., Port Washington, Wis. 53074; Michael F. Drzewiecki, Saukville, Wis.

[73] Assignee: Richard A. Young, Port Washington, Wis.

[21] Appl. No.: 796,820

[22] Filed: Feb. 6, 1997

[51] Int. Cl.[6] ..... A47C 7/50

[52] U.S. Cl. ..... 297/423.11; 297/195.11; 297/217.1; 297/1; 297/3; 297/423.13; 206/216; 206/372

[58] Field of Search ..... 297/423.11, 423.12, 297/423.13, 195.11, 283.1, 217.1, 1, 3, 188.08; 206/216, 234, 372, 373; 280/32.5, 32.6

[56] References Cited

U.S. PATENT DOCUMENTS

| | | | |
|---|---|---|---|
| 952,948 | 3/1910 | Ryder | 182/129 |
| 1,169,008 | 1/1916 | Chase . | |
| 2,154,606 | 4/1939 | Covington | 297/195.11 |
| 2,237,909 | 4/1941 | Lund | 155/166 |
| 2,526,767 | 10/1950 | Parker | 155/1 |
| 2,667,658 | 2/1954 | Cornick | 15/265 |
| 2,860,688 | 11/1958 | Edge | 297/195.11 |
| 3,051,540 | 8/1962 | Wood | 312/235 |
| 3,099,398 | 7/1963 | Croteau | 240/4 |
| 3,407,899 | 10/1968 | Delafrange | 182/20 |
| 3,590,949 | 7/1971 | Monroe | 182/129 |
| 3,976,155 | 8/1976 | Esch | 280/32.5 |
| 4,366,998 | 1/1983 | Kaiser | 312/235 R |
| 4,458,784 | 7/1984 | Holmes | 182/230 |
| 4,632,410 | 12/1986 | Bainbridge et al. | 280/32.5 |
| 4,953,601 | 9/1990 | Herdies | 144/285 |
| 5,330,254 | 7/1994 | Larson | 297/423.12 |
| 5,350,065 | 9/1994 | Darrey | 206/373 |
| 5,429,265 | 7/1995 | Maire et al. | 220/522 |
| 5,435,642 | 7/1995 | Kennedy | 312/235.2 |
| 5,577,800 | 11/1996 | Earl, Jr. | 297/423.12 |

FOREIGN PATENT DOCUMENTS

| | | | |
|---|---|---|---|
| 2202138 | 9/1988 | United Kingdom | 297/423.13 |

*Primary Examiner*—Peter M. Cuomo
*Assistant Examiner*—Anthony Barfield
*Attorney, Agent, or Firm*—Whyte Hirschboeck Dudek S.C.

[57] ABSTRACT

A multiple position work is disclosed caddy seat or stool which has a base and at least two rest surfaces to support a worker. The stool and rest surfaces are constructed and arranged to properly balance the worker's weight and relieve stress and strain on a worker's neck, upper body, and back and to provide comfort to a worker. The work stool also includes a storage compartment for caddying tools and which is easily accessible when used in any of the positions. Additionally, the stool may have limb rests for when the worker is working in a kneeling position. Cushions are provided on the rest surfaces to provide maximum comfort for the worker. The work stool is designed for use by heating, ventilating, and air conditioning technicians, but is readily adaptable to for use by plumbers, electricians, masons, mechanics, janitors, gardeners, and the like.

18 Claims, 4 Drawing Sheets

FIG. 6
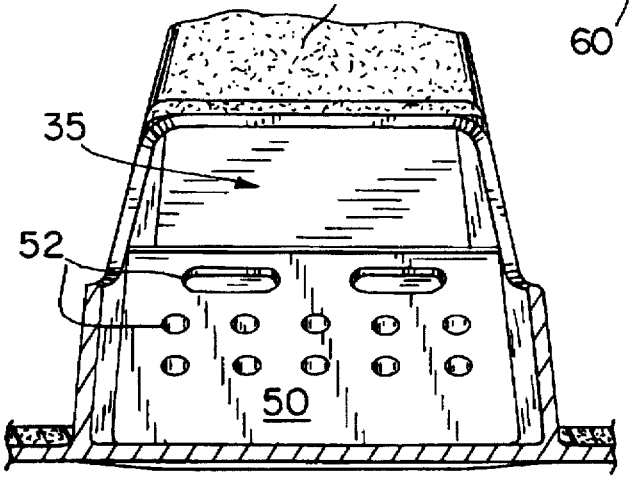
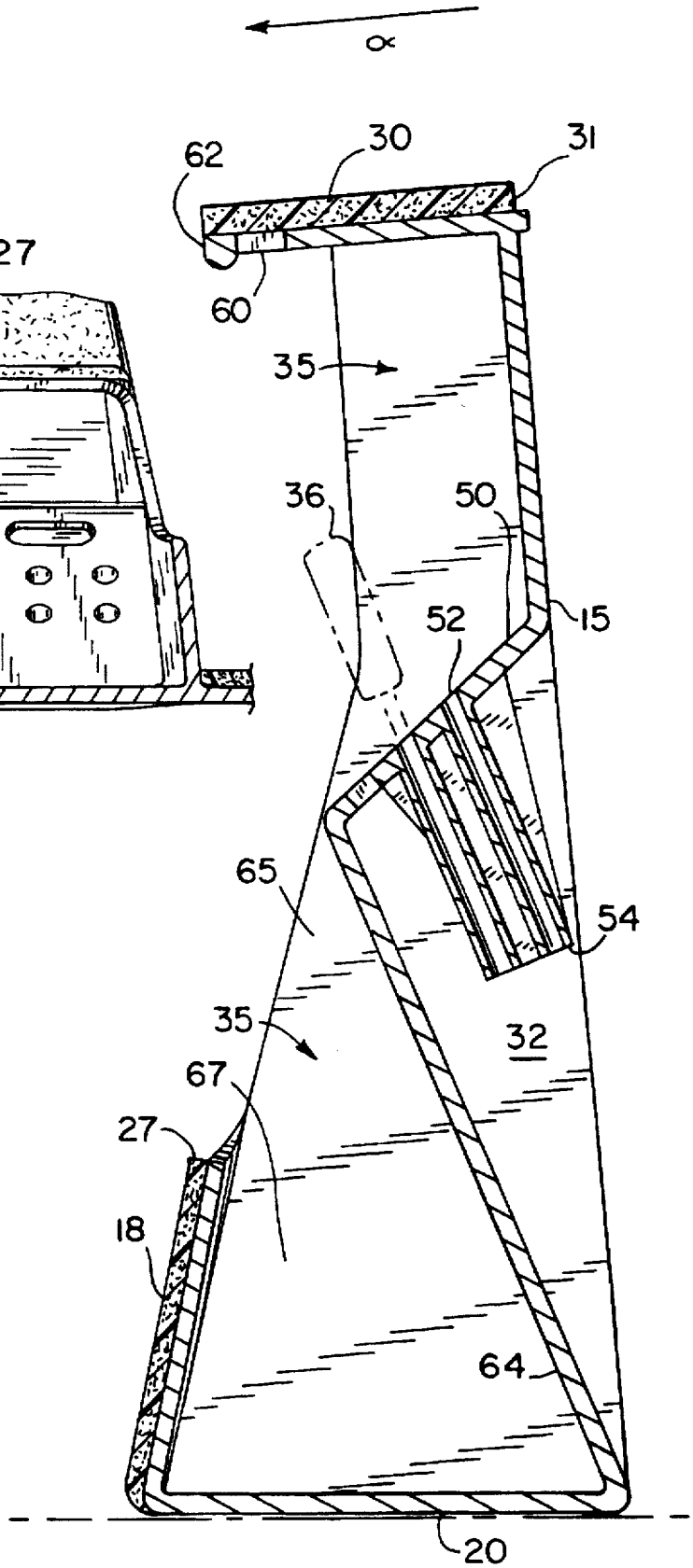
FIG. 4

MULTIPLE POSITION TOOL CADDY SEAT

BACKGROUND OF THE INVENTION

1. Field of the Invention

The present invention is directed to a work stool or seat for supporting a worker. More specifically, the present invention relates to a work stool that is capable of supporting a worker in at least a first position at a first height and in a second position at a second height different from and above the first height and that has an easily accessible storage compartment to allow the worker to store and caddy his or her tools.

2. Description of the Prior Art

Heating, ventilating and air conditioning technicians, plumbers, electricians, masons, mechanics, carpenters, janitors, gardeners, and the like, are forced by their day-to-day tasks to work close to the ground and in varied positions. Thus, they often are required to do a lot of bending, kneeling, and stooping. This constant bending, kneeling, and stooping can be quite tiring for the worker if the position is maintained for any period of time. Furthermore, constant bending, kneeling, and stooping may cause severe stress on the worker's neck, back, knees, etc. Such stress and strain can be extremely detrimental to the worker and may eventually put the worker on bed rest for several days keeping him or her from work, or worse, cause permanent injuries that can shorten their careers. To avoid such fatigue and neck, back and knee stress and strain, some workers choose to occasionally rest by kneeling or sitting on the cold, damp and sometimes muddy ground. Not only does this oftentimes soil the worker's clothing, but prolonged kneeling or sitting on a cold, damp or wet surface aggravates the above mentioned problems and may also be unhealthy. For example, kneeling or sitting on the ground may chill the body and weaken it, leaving the worker more susceptible to cold or flu symptoms or may eventually lead to other health problems such as arthritis.

These workers would thus be better off if they had access to a convenient work stool or seat that allowed them to kneel and sit when necessary. Stools of this sort are suggested in the prior art, such as the stool taught in U.S. Pat. No. 2,237,909. Unfortunately, prior art stools teach just one resting position which allows the worker to rest in only a single position. However, because the worker may need to get lower to the ground for some tasks and higher off the ground for others, it is particularly advantageous to have a stool that offers the worker more than one rest position. For example, a multiple position stool would allow the worker to avoid the bending, stooping, and reaching inherent to a single position stool and would eliminate the need to carry multiple stools with varying heights.

It also important for the worker to have easy access to his or her tools. Most workers are limited in the amount equipment and tools they can carry by the limited storage capacity of their truck or van. Again the prior art suggests a variety of combined tool carriers and stools. For example, the general principal of tool carrying stools is illustrated by U.S. Pat. Nos. 5,429,265; 4,366,998; 3,099,398; and 1,169,008. However, the prior art does not suggest a multiple position work stool that has a tool storage compartment that is accessible from any of the multiple rest positions. Therefore, it is highly desirable to combine the multiple position stool with a tool caddy having a storage compartment which is easily accessible from each position and has sufficient capacity to properly house and organize required tools and other equipment.

Furthermore, while various combined tool caddies and stool devices have been employed in the prior art, none have been constructed and arranged to properly support and balance the workers' body in order to minimize the amount of neck, upper body, back, and knee stresses and strains. It would therefore be desirable to have a work stool that would solve all the aforementioned problems, including to properly distribute the weight of the worker to relieve neck, upper body, and back strain.

Further, it would be desirable for a work stool to have limb rests to allow the worker to comfortably kneel upon or brace and support his or her feet against.

SUMMARY OF THE INVENTION

The work stool of the present invention has a first rest surface capable of supporting a worker in a first position at a first height, a second rest surface capable of supporting the worker in a second position at a second height above the first height, a first base constructed and arranged to support the first rest surface, and a second base constructed and arranged to support the second rest surface. A first side panel and a second side panel are connected to the first and second rest surfaces and the first and second base to form an easily accessible storage compartment for the worker's tools. A pair of knee supports are provided and extend outwardly from the base useable by the worker to keel on while in one of the positions.

The storage compartment may have an optional, removable third panel or face panel having a multitude of apertures for receiving the shafts or handles of tools and a cavity for large and odd-sized tools. A multitude of sockets extend from the face panel and the apertures to further aid in the segregation of the worker's tools. A carrying handle is incorporated into the work stool so that the worker may easily lift and carry the work stool.

Accordingly, it is the general object of the present invention to provide a work stool with multiple rest surfaces to allow the worker to comfortably rest in several positions.

Another object of the invention is to provide a multiple rest position work stool which is constructed and arranged to properly support and balance the worker's body and to minimize fatigue.

Another object is to provide a work stool which allows the worker easy access to his or her tools while in any of several rest positions.

It is yet another object of the present invention to provide a work stool in combination with a tool holder that is compact and lightweight yet is durable and easy to carry. Yet another object of the present invention is to provide limb rest surfaces.

Various other features, objects, and advantages of the present invention and the manner in which they are achieved will be made apparent from the following detailed description, drawings, and claims.

BRIEF DESCRIPTION OF THE DRAWINGS

The drawings illustrated the best mode presently contemplated for carrying out the invention.

In the drawings:

FIG. 4 is a sectional view of the stool in the second position taken generally along the line 4—4 of FIG. 3;

FIG. 6 is a partial sectional view taken generally along the line 6—6 of FIG. 3.

DETAILED DESCRIPTION OF THE PREFERRED EMBODIMENT

Figure 1:
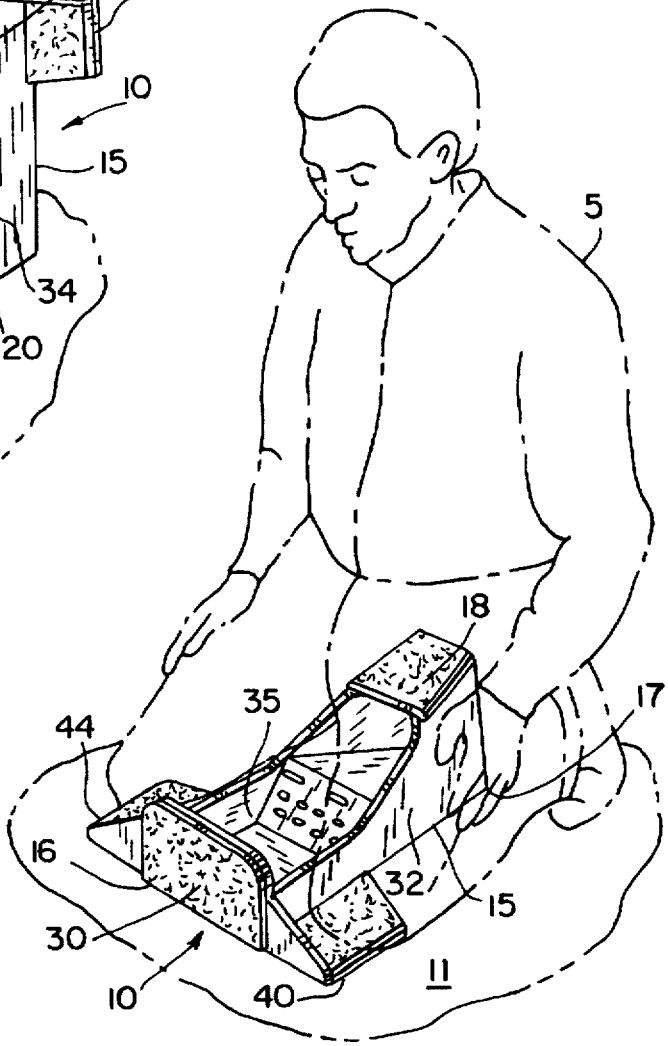
FIG. 1 is a perspective view of a work stool in accordance with the present invention showing a worker in shadow seated in a first position at a first height.

As shown in FIG. 1, a worker 5 is supported by a work stool 10 made of wood, metal, plastic or any similar rigid material. A first base 15 having a first end 16 and a second end 17 supports the stool 10 upon the ground 11. It will also be appreciated that the stool 10 may be used on a surface other than the ground, such as a floor, therefore the term "ground" is intended to include all such surfaces. On top of the stool 10, the worker 5 rests in first position at a first height on a first rest surface or first seat 18.

Figure 2:
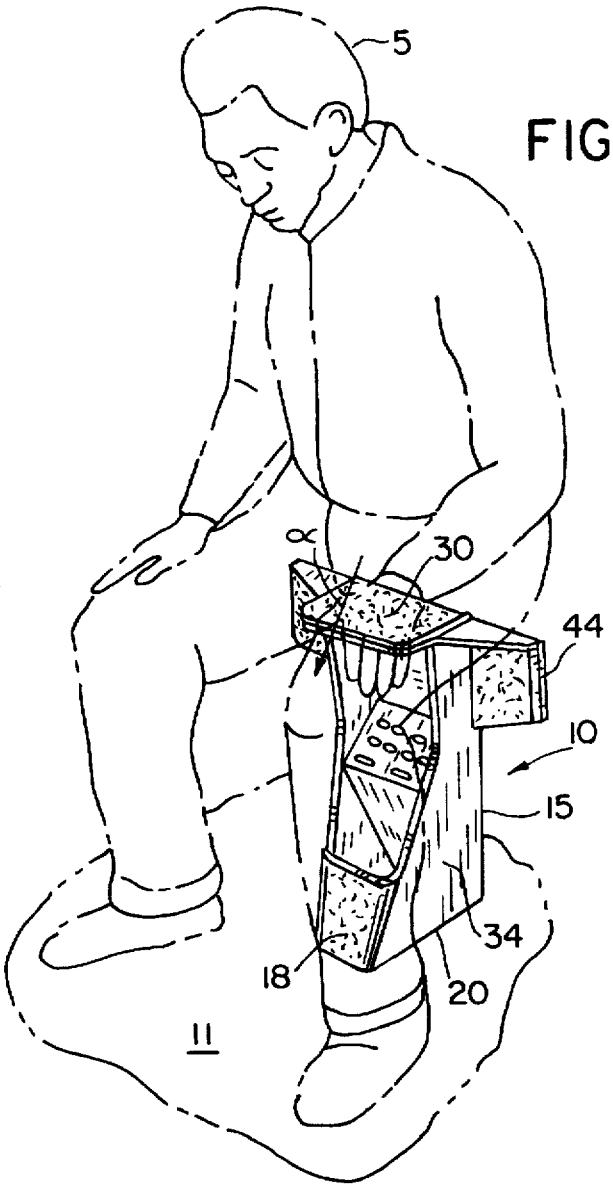
FIG. 2 is a perspective view of the work stool of FIG. 1 with the worker in shadow seated in a second position at a second height.

Referring to FIG. 2, the work stool 10 is shown with the worker 5 seated in a second position at a second height. In this second position, the stool 10 rests on the ground 11 on a second base 20 while the worker 5 now rests on a second rest surface or second seat 30. When the stool 10 is resting on the second base 20, the second seat 30 is at a second height different from and above the first height of first seat 18. In the preferred embodiment, the first seat 18 is located at a first height which is 10 inches above the ground 11, while the second seat 30 is located at a second height which is 21.5 inches above the ground 11. This allows the worker 5 to more comfortably reach higher work areas from the higher second seated position than he or she can from lower first seated position.

Figure 3:
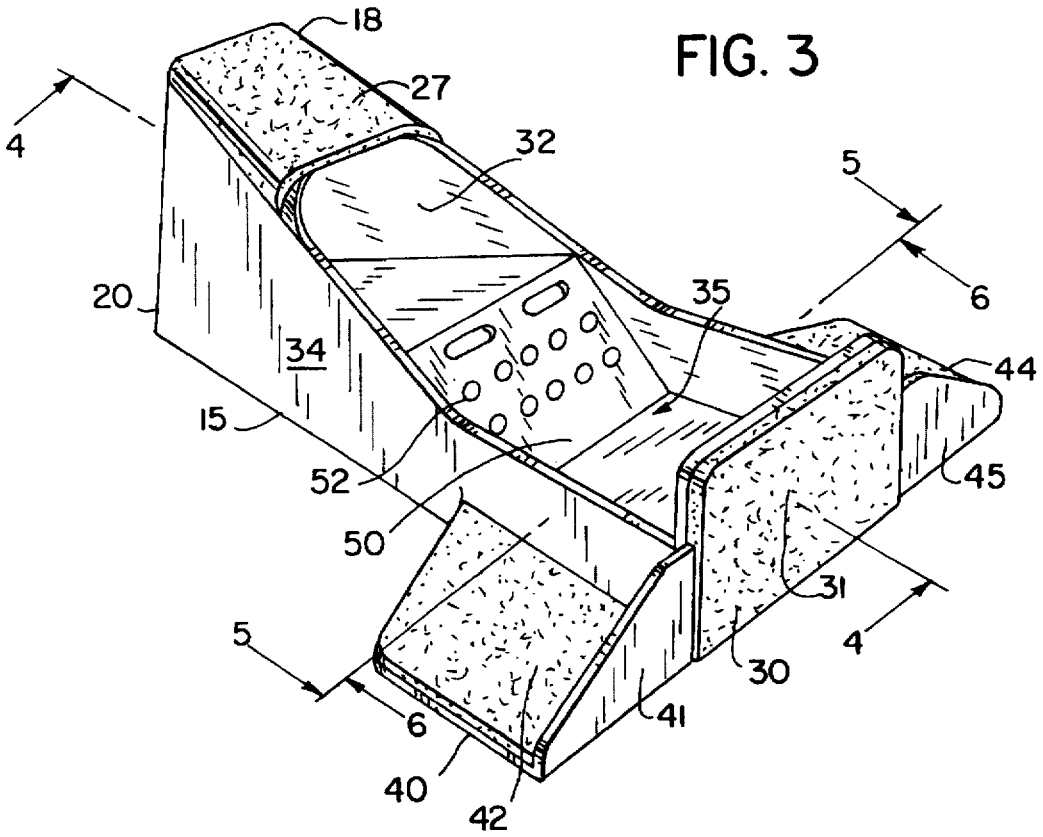
FIG. 3 is an enlarged perspective view of the work stool of FIG. 1.

Referring now to FIG. 3, a first seat cushion 27, which can be made of foam rubber is attached to the first seat 18. A second seat cushion 31, which can be also made of foam rubber, is attached to the second seat 30. The cushions 27, 31 provide the worker 5 with additional comfort, support, and insulation while he or she is resting on the seats 18 and 30.

A first substantially trapezoidal-shaped side panel 32 extends upwardly from the base 15. A substantially trapezoidal-shaped second side panel 34 parallel to the first side panel 32 also extends upwardly from the base 15. The side panels 32, 34 may be connected along their bottom edges to the base 15 by gluing, nailing, riveting or the like. In one preferred embodiment, the entire stool 10 is made of injected-molded, high-impact plastic, and thus the panels 32, 34 are not actually connected to the base but rather are integral with the base 15.

With the stool 10 resting on the first base 15 as shown in FIG. 1 and 3, the top edges of the panels 32 and 34 carry the first seat 18 and the attached first seat cushion 27. In this first position, the seat 18 slopes generally forward so that the worker's weight is evenly distributed over and balanced on the stool 10. Thus, the seat 18 comfortably supports the worker in either a vertically upright position as shown in FIG. 1, or when the worker is leaning forward to reach outward. Further, this gentle slope of the seat 18 allows the worker 5 to sit comfortably in the first position while relieving stress on the worker's upper body, neck and lower back. Similarly, in the second seated position as shown in FIG. 2, the second seat 30 is sloped generally downwardly toward first seat 18, as indicated by arrow α so that the worker's weight is again evenly distributed over and balanced on the stool 10. The second seat 30 is sloped to also relieve the stress and strain on the worker's body, neck and lower back.

As shown in FIG. 3, the stool 10 is also provided with a pair of kneeling rest surfaces or wings 40, 44 that are integral with the base 15. Each wing 40 is approximately 6 inches long and 5 inches wide. As best shown in FIG. 1, when the worker 5 is in the kneeling position, the worker's limbs rest on the first wing 40 and the second wing 44. The first wing 40 and the second wing 44 are provided with wing cushions 42, 46 respectively, to provide maximum comfort for the kneeling worker.

Figure 5:
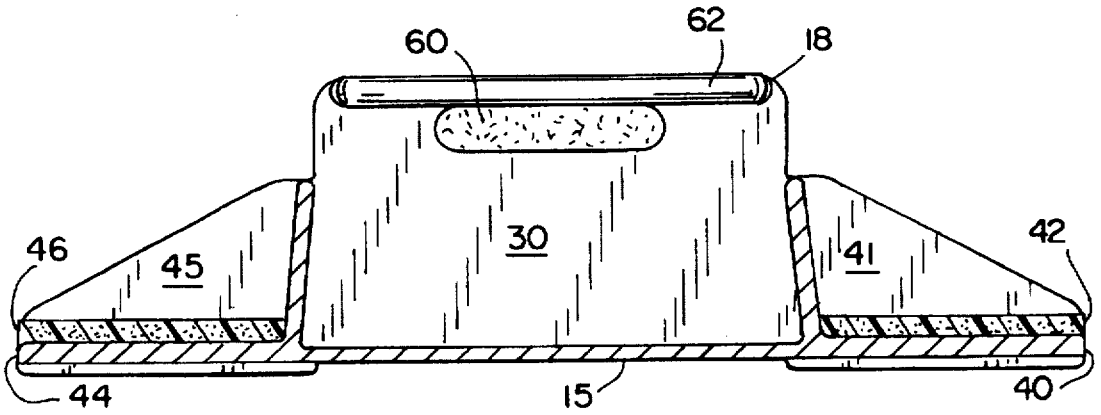
FIG. 5 is a sectional view taken generally along the line 5—5 of FIG. 3.

As best shown in FIGS. 3 and 5, wing support brackets 41, 45 may be attached to the first wing 40 and second wing 44 respectively, to more tightly secure the wings to the base 15. The wing support brackets 41, 45 and wings 40, 44 may serve as foot rests instead of knee rests if so desired, and may thus prevent the worker 5 from sliding forward and falling off the first seat 18 or may give the worker added leverage that may be needed to complete a task.

As best shown in FIGS. 3 and 4, the first base 15, the side panels 32, 34, the second base 20, and the seats 18, 30 form a partially covered box or storage compartment 35. The storage compartment 35 allows the worker 5 to store tools or other such equipment such as a screwdriver 36, as shown in shadow in FIG. 4. The storage compartment 35 lies between the workers legs so that it is easily accessible to the worker 5 when the worker is seated in either the first position or the second position.

In one preferred embodiment, a third or face panel 50 lies within the storage compartment 35 that may be removable. The face panel 50 is arranged to slope generally downward toward the second seat 30 so that it can be easily examined and reached by the worker 5 from either seated position. The face panel 50 has a multitude of apertures 52 for receiving the handles or shanks of tools such as the screwdriver 36 shown in FIG. 4. Hollow, tubular sockets 54 extending inwardly may be attached to the back side of the face panel 50 and aligned with a corresponding aperture 52. These sockets 54 support the tools' shafts or handles to prevent the dangling shafts and handles from getting tangled, thus further aiding in the worker's access to the tools.

As best illustrated in FIGS. 4 and 5, the stool 10 has a carrying handle 60 within the second seat 30 for convenient handling by the worker 5. The carrying handle includes a grip 62 which is rounded to fit properly within the hand of the worker 5 when the work stool 10 is being carried by the worker 5. It will be obvious to one skilled in the art that the handle could also be a carrying strap, an external C-shaped handle, or the like.

When the stool 10 is being carried by the handle 60, the tools 36 stored in the storage compartment 35 remain safely tucked away in their corresponding apertures 52 and sockets 54 because of the angle of the face panel 50 as shown in FIG. 5. Any tools which might be in the storage compartment 35 but are not stored in the face panel 50 would be prevented from tumbling out by the first seat 18 and a fourth panel or back panel 64 which form a narrow throat 65 leading to a cavity 67. The fourth or back panel 64 is connected to the third panel 50 at a top end and generally slopes downwardly toward the intersection of the first base 15 and second base 20 and may be removable and/or adjustable to allow for varying the size of the storage areas.

Where panels 50 and 64 are constructed to be adjustable and/or removable, or where the stool/tool caddy is constructed without the panel 50, the storage areas may be customized for different types of users. For example, removing panel 50 would provide two storage areas for larger tools and supplies. A janitor may use the stool in this manner to store rags and cleaning supplies. Where panel 64 is removable, one large storage compartment is formed which would be desirable to a mason, for example, to hold a variety of trowels, or a gardener to hold gardening tools.

In use, the stool 10 of the present invention may be utilized to support the worker 5 in the first position on the first base 15 at the first height as shown in FIG. 1. When a different height above the first height is desired, the worker 5 merely turns the stool 10 over so that the stool now rests on second base 20 as shown in FIG. 2. The storage compartment 35 and face panel 50 of the work stool 10 are constructed and arranged to allow the worker 5 to access the work tools, such as the screwdriver 36, between his or her legs when sitting in either the first seated position shown in FIG. 1 or the second seated position shown in FIG. 2.

The work stool 10 is constructed and arranged to gently slope forward such that each of the seats 18, 30 properly distribute and balance the worker's weight while in either of the two seated positions. These gently sloping seats 18, 30 also relieve pressure on the worker's back, upper body and neck allowing the worker to comfortably perform the tasks at hand. Accordingly, the first base 15 and the second base 20 each form a stable support surface so that the worker 5 is able to maintain stability and safety in either the first position or the second position.

Figure 7:
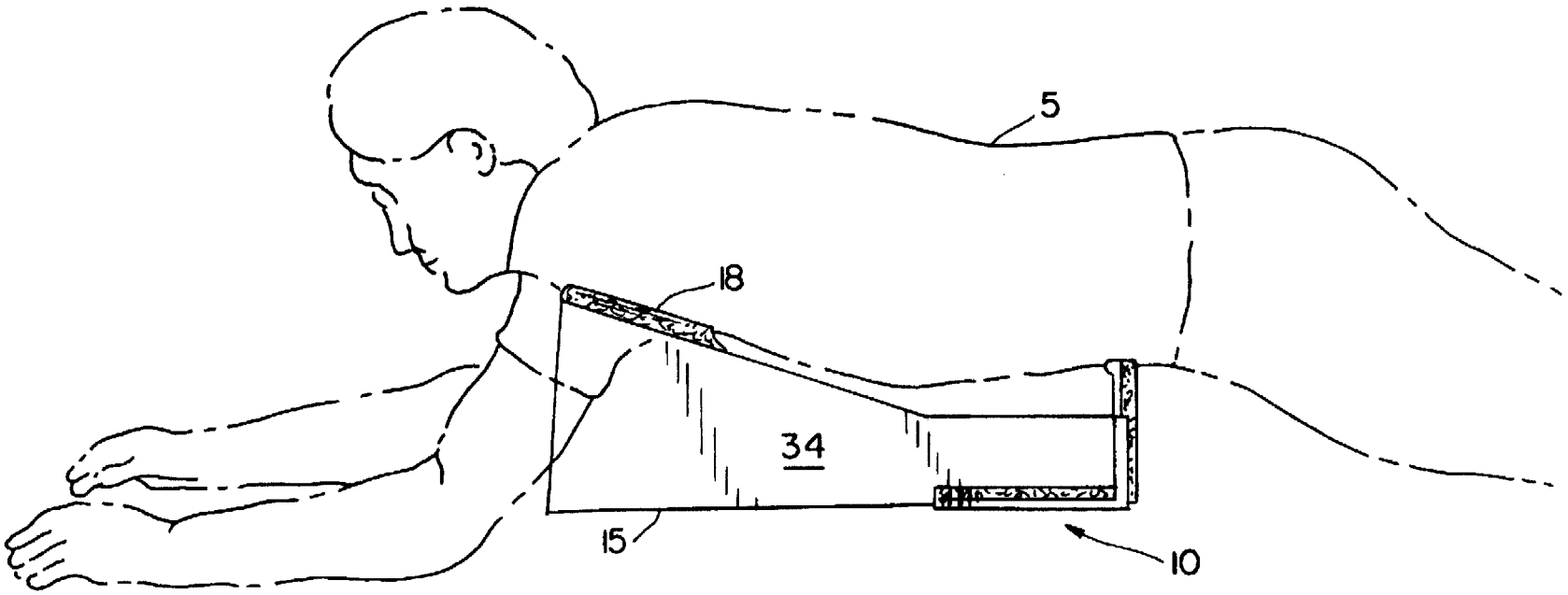
FIG. 7 is a side view of the work stool of FIG. 1 illustrating the worker lying in a third rest position.

From the foregoing, it may also be seen from this invention that the worker 5 may lie face down, as best shown in FIG. 7, upon the first rest surface 18. In this third position, the worker's torso is supported in such a way that the worker may be able to reach positions much lower than he or she is able to comfortably reach in the first seated position shown in FIG. 1. Furthermore, the worker 5 may rest his or her back on the first rest 18 in a fourth position and comfortably reach upwardly to perform any necessary tasks. In both the third and fourth positions, the worker is supported comfortably above the cold and damp ground.

In one preferred embodiment, when resting on the first base 15, the work stool 10 stands about 10 inches tall, is about 19 inches across from the edge of wing 41 to the edge of wing 44, and is about 21.5 inches long. As mentioned earlier, the work stool 10 may be constructed of high impact plastic such as PVC or maybe constructed of wood, metal, or a combination of any substantially rigid, light weight materials. The cushions 27, 31, 42, and 46 may be constructed of a soft, deformable rubber or polyurethane foam or some similar material.

In the above detailed description, it will be seen that this invention may be adapted to obtain all ends and objects herein set forth, together with other advantages which are obvious and which are inherent to the structure. It will also be understood that certain features and sub-combinations are of utility and may be employed without reference to other features and sub-combinations. This is contemplated by and is within the scope of the claims. As many possible embodiments may be made of the invention without departing from the scope thereof, it is to be understood that all matter herein set forth and shown in the accompanying drawings, is to be interpreted as illustrative and not in a limiting sense.

I claim:

1. A work stool for supporting a worker in least two positions comprising:

a base having a first end and a second end;

a first rest surface connected to the first end of the base capable of supporting a worker in one position, the first rest surface having a first height;

a second rest surface connected to the second end of the base capable of supporting the worker in another position, the second rest surface having a second height different from the first height;

a pair of knee supports extending outwardly from the base; and a storage compartment located between the first and second rest surfaces and adjacent the base, the storage compartment comprising a face panel having an aperture capable of receiving a tool therein, the face panel being accessible to the worker in either position.

2. The work stool of claim 1, wherein the storage compartment further has a cavity adjacent to the face panel and the face panel has a multitude of apertures of varying sizes.

3. The work stool of claim 1, wherein the storage compartment further comprises sockets in cooperation with the face panel and a multitude of apertures to receive tools.

4. The work stool of claim 1, further comprising a cushion attached to the first rest surface and a cushion attached to the second rest surface.

5. The work stool of claim 1, wherein the pair of knee supports are integral members of the base and have cushions thereon.

6. The work stool of claim 1, further comprising a handle in the second rest surface for carrying the work stool.

7. The work stool of claim 1, further comprising a first and second side panel attached to the base.

8. The work stool of claim 1, wherein the first rest surface is capable of supporting the worker in more than one position.

9. A work stool for supporting a worker in more than one position comprising:

a first rest surface capable of supporting a worker in a first position;

a second rest surface capable of supporting the worker in a second position, different from and above the first position;

a first base constructed and arranged to support the first rest surface;

a second base constructed and arranged to support the second rest surface;

a storage compartment adjacent to the first base which is constructed and arranged to be accessible to the worker in each position, the storage compartment including a face panel for receiving tools; and first and second side panels, wherein each side panel is attached to the first rest surface to form the storage compartment.

10. The work stool of claim 9, wherein the storage compartment further has a cavity adjacent to the face panel for receiving tools.

11. The work stool of claim 9, wherein the face panel has a multitude of apertures of varying sizes.

12. The work stool of claim 10, wherein the storage compartment further comprises a multitude of apertures and sockets in cooperation with the face panel.

13. The work stool of claim 9, further comprising a cushion carried by the first rest surface and a cushion carried by the second rest surface.

14. The work stool of claim 9, further comprising a pair of limb rest surfaces connected to the first base.

15. The work stool of claim 14, further comprising a cushion attached to each of the limb rest surfaces.

16. The work stool of claim 9, further comprising a handle attached the work stool to aid the worker in carrying the work stool.

17. A work stool for supporting a worker above ground comprising:

a base;

a pair of wings integral with the base;

a first side panel extending upwardly from the base;

a second side panel extending upwardly from the base;

a first seat attached to the first side panel and the second side panel for supporting a worker at a first height;

a second seat attached to the first side panel and the second side panel for supporting the worker at a second height different from the first height; and a storage compartment for storing at least one tool, the storage compartment formed by the base, the first side panel, the second side panel, a back panel between the first and second side panels, and a face panel adjacent the back panel, the face panel having apertures therein and sockets extending from it for receiving tools.

18. The work stool of claim 17, further comprising:

a handle integral with the second seat surface;

seat cushions affixed to the first and second seats;

a first bracket attached to the first wing and first side panel;

a second bracket attached to the second wing and the second side panel; and wing cushions affixed to the first and second wings.

* * * * *